United States Patent [19]

Ahmed et al.

[11] 4,096,721

[45] Jun. 27, 1978

[54] HYDROSTATIC EXTRUSION METHODS AND APPARATUS

[75] Inventors: Nazeer Ahmed, Princeton, N.J.; Ivan Gerald Histand, Cornwells Heights, Pa.

[73] Assignee: Western Electric Company, Inc., New York, N.Y.

[21] Appl. No.: 790,734

[22] Filed: Apr. 25, 1977

[51] Int. Cl.[2] ..... B21C 23/32

[52] U.S. Cl. ..... 72/60; 72/41; 72/253 R; 72/467

[58] Field of Search ..... 72/43, 44, 42, 60, 253, 72/467, 262

[56] References Cited

U.S. PATENT DOCUMENTS

| | | | |
|---|---|---|---|
| 56,622 | 7/1866 | Shaw | 72/467 |
| 1,597,927 | 8/1926 | Simons | 72/467 X |
| 2,907,454 | 10/1959 | Sejournet | 72/467 X |
| 2,971,644 | 2/1961 | Sejournet | 72/467 X |
| 3,756,054 | 9/1973 | Nilsson | 72/467 X |
| 3,985,011 | 10/1976 | Fuchs, Jr. | 72/60 |

*Primary Examiner*—Leon Gilden
*Attorney, Agent, or Firm*—A. S. Rosen

[57] ABSTRACT

The disclosure concerns methods and apparatus for forming an elongated product, having a high quality surface appearance and finish, from an elongated workpiece with a wax coating. The wax-coated, elongated workpiece is advanced toward, and then through, an aperture which extends longitudinally through a die, by an application of frictional drag forces, in the direction of the die, to the wax coating. The wax, however, does not pass through the die aperture, but rather is substantially completely removed from each successive element of the elongated workpiece, substantially as such element reaches the die.

8 Claims, 5 Drawing Figures

HYDROSTATIC EXTRUSION METHODS AND APPARATUS

BACKGROUND OF THE INVENTION

1. Field of the Invention

This invention relates to methods and apparatus for forming an elongated product from an elongated workpiece, which elongated workpiece is coated with a hydrostatic medium, and, more particularly, to methods and apparatus for forming an elongated product from an elongated workpiece, which elongated workpiece is coated with a hydrostatic medium, wherein a high quality surface appearance and finish is required for the elongated product.

2. Description of the Prior Art

In the art of forming elongated products, it is known to utilize hydrostatic extrusion techniques, wherein hydrostatic pressure is applied to an elongated workpiece within a chamber, such that the material of the elongated workpiece is rendered more ductile, as the elongated workpiece is forced through an aperture in a die located at one end of the chamber. An example of such technique may be found in U.S. Pat. No. 3,985,011 to F. J. Fuchs, Jr., wherein a continuous hydrostatic extrusion technique is employed in order to form very large quantities of the elongated product, e.g., wire, at a high rate and a relatively low cost.

It is known, also, to provide a coating of a hydrostatic medium on the elongated workpiece undergoing such a hydrostatic extrusion process. For example, previously mentioned U.S. Pat. No. 3,985,011 suggests the use, as an appropriate hydrostatic medium, of a shear transmitting medium with high viscosity and shear strength, having the capability of lubricating the extrusion die while providing good wetting action on the workpiece, and also having minimal viscosity variation with respect to pressure, temperature and shearing rate, such as beeswax or polyethylene wax. Accordingly, the term "wax" will be used herein, interchangeably with the term "hydrostatic medium," to represent any of a number of various media which may have some or all of the described characteristics.

In certain instances, a very high quality surface appearance and finish may be desired for the elongated product, e.g., to enhance its solderability characteristics. Our research has established that the presence of wax on the extruded, elongated product, and even the presence of wax within the die aperture during extrusion, tends to detract from the surface appearance and finish of such elongated product. The adverse effect caused by the presence of wax within the die aperture during extrusion is believed to result from high shear rates and excessive temperature rises in the wax.

In many cases, however, such as the technique of previously discussed U.S. Pat. No. 3,985,011, the presence of the wax coating on the elongated workpiece is considered advantageous during at least a portion of the extrusion process. Thus, the wax may constitute a hydrostatic medium through which both frictional drag forces in the direction of the die aperture, and a hydrostatic pressure which increases continuously toward the die aperture, may simultaneously be applied to the elongated workpiece. The elongated workpiece will thereby be advanced into the die aperture as the pressure within the material of the advancing elongated workpiece increases, such pressure increase serving to render the workpiece material more ductile and, thus, more readily subject to extrusion through the die aperture.

A technique for removing a lubricant from a heated, elongated workpiece within a die, through which die the elongated workpiece is undergoing extrusion, is disclosed in U.S. Pat. No. 2,907,454 to J. Sejournet. In particular, each proposed die structure disclosed in such patent includes an enlarged clearance space between two, axially aligned, die apertures. In each of two suggested embodiments, a set of passageways extends radially from the clearance space to the exterior of the die and permits an escape of lubricant between two successive stages of extrusion, one in each of the two die apertures of the die structure. Such arrangement is considered to limit greatly the range of extrusion pressures which may be employed, in that a plastically deforming workpiece would tend to be squeezed out through the radial passageways and/or to block such passageways and, thus, interefer with continued escape of the lubricant. In addition, substantially all of the reduction in the cross-section of the elongated workpiece appears in such U.S. Pat. No. 2,907,454 to occur in the first stage of extrusion, prior to entry of the hot, elongated workpiece into the clearance space, so that the major portion of the extrusion operation occurs with the elongated workpiece still fully lubricated, and subject, therefore, to damage caused by the previously mentioned high shear rates and excessive temperature rises in the wax. Moreover, the clearance space, as disclosed in such patent, appears not to be designed for the removal of substantially all, but rather for the removal of only a portion, of the lubricant coating from the surface of the elongated workpiece, prior to the second stage of extrusion. Thus, even the second stage of extrusion is performed upon a still partially lubricant-coated, elongated workpiece.

SUMMARY OF THE INVENTION

The invention contemplates methods and apparatus for forming an elongated product from an elongated workpiece, where the elongated workpiece is coated with a hydrostatic medium, such as a suitable wax. Such forming technique includes an application of frictional drag forces to the hydrostatic medium in the direction of a die so as to advance the elongated workpiece longitudinally, first toward an aperture extending longitudinally through the die, and then through the die aperture. Such forming technique also involves the removal of substantially all of the hydrostatic medium from each successive longitudinal element of the elongated workpiece, substantially as the longitudinal element reaches the die, such that the elongated workpiece passes through the die aperture in substantially uncoated condition. As a result, an elongated product, having a high quality surface appearance and finish, is produced.

DETAILED DESCRIPTION

Figure 1:
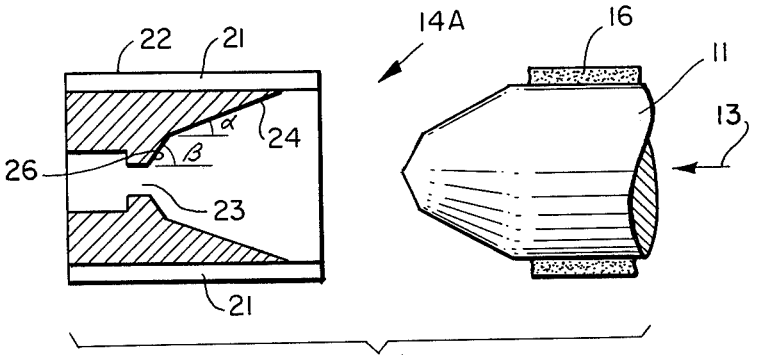
FIG. 1 of the drawing is a side elevational view, partly in section along the line 1—1 in FIG. 2, of a die configured in accordance with the principles of the invention, and a leading end of an elongated workpiece, the elongated workpiece having a coating of a hydrostatic medium on its outer periphery.
Figure 3:
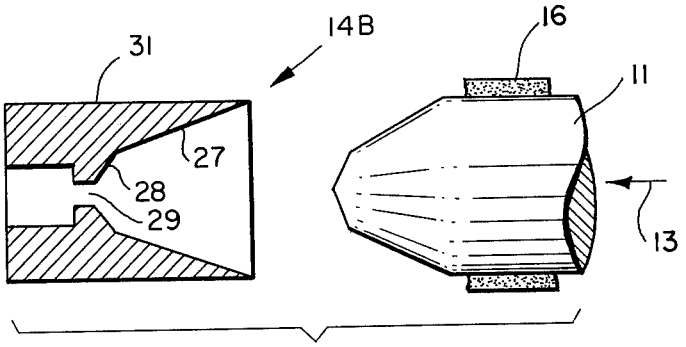
FIG. 3 is a side elevational view, partly in section along the line 3—3 of FIG. 4, of an alternative die configured in accordance with the principles of the invention, and a leading end of an elongated workpiece, the elongated workpiece having a coating of a hydrostatic medium on its outer periphery.
Figure 5:
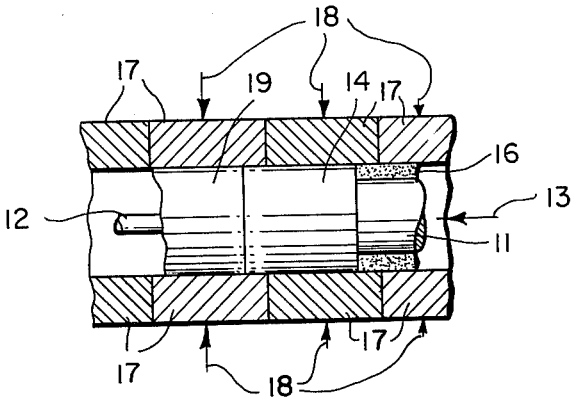
FIG. 5 is a side elevational view, partly in section, of portions of an apparatus which may be employed to force a coated, elongated workpiece toward and through a die, such as the die of FIGS. 1 and 2 or the alternative die of FIGS. 3 and 4, in order to form an elongated product.

Referring initially to FIGS. 1, 3 and 5 of the drawing, a leading end (FIGS. 1 and 3) of an elongated workpiece 11 is shown. The elongated workpiece 11 is to be so deformed as to produce an elongated product 12 (FIG. 5). The elongated workpiece 11 may constitute metallic rod composed, e.g., of copper, aluminum or lead, while the elongated product 12 may be metallic wire.

An apparatus for forming the elongated product 12 from the elongated workpiece 11, which apparatus constitutes the subject matter of U.S. Pat. No. 3,985,011 to F. J. Fuchs, Jr., is outlined in FIG. 5 of our drawing. The required deformation of the elongated workpiece 11 is accomplished by forcing the elongated workpiece 11 longitudinally, in the direction of arrow 13, through a suitably configured aperture in a die 14. The elongated workpiece 11 is advanced in the direction of the arrow 13 by the technique of first coating the outer periphery of the elongated workpiece 11 with a suitable hydrostatic medium, such as the wax 16, and then advancing a number of trains of gripping element sectors 17,17 in the direction of the arrow 13 toward and past the die 14 such that frictional drag forces are applied to the wax 16 by the moving sectors 17,17. Thus, the wax 16 transmits the frictional drag forces from the sectors 17,17 to the elongated workpiece 11, causing the elongated workpiece 11 to move in the direction of the arrow 13. The wax 16 preferably also serves as a medium for transmitting a longitudinally increasing, compressive pressure to the elongated workpiece 11, corresponding to an increase in pressure on the elongated workpiece 11 as it approaches and then enters the die 14. Such longitudinally increasing, compressive pressure is represented by arrows 18,18, which increase in size from right to left in FIG. 5, i.e., in the direction of the arrow 13, toward the die 14. A suitable die stem 19 supports the die 14.

Figure 2:
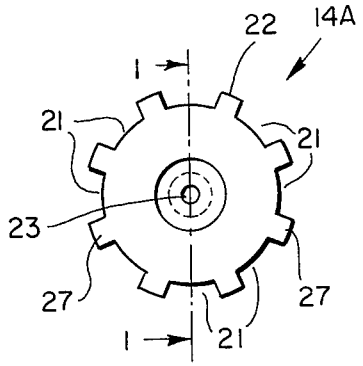
FIG. 2 is an end elevational view of the die of FIG. 1, illustrating additional aspects of the die.

Turning now to FIGS. 1 and 2 of the drawing, it is desired that the elongated product 12 have a high quality surface appearance and finish. As indicated previously, however, our research has established that a major factor inhibiting high quality in the surface appearance and finish of a product, such as the elongated product 12, involves the presence of the wax 16, both within the aperture of the die 14 during extrusion, and on the exterior of the finished, elongated product 12 following extrusion. We have now devised a technique which involves the removal of substantially all of the wax 16 from the outer periphery of each successive element of the elongated workpiece 11 as such element advances into the die 14. A first embodiment of a die for so removing the wax 16 from the elongated workpiece 11, die 14A, is illustrated in FIGS. 1 and 2.

The die 14A preferably has the general configuration of a right, circular cylinder, with an outer diameter somewhat larger than the elongated workpiece 11 which is to be forced through the die 14A. For example, the outer diameter of the die 14A may be either approximately equal to, or slightly larger than, the combined diameter of the elongated workpiece 11 and the coating of the wax 16 on the elongated workpiece 11. A number of grooves or surface channels 21,21 extend longitudinally along the outer periphery 22 of the die 14A. Each channel 21 is of such depth that the radial distance from the center of the die 14A to the bottom of the channel 21 is substantially equal to the radius of the elongated workpiece 11 beneath the coating of the wax 16.

While the foregoing description presupposes that the elongated workpiece 11 is of circular cross-section, such need not be true. In such instances as non-circular workpiece cross-sections may be involved, corresponding non-circular die configurations would, of course, be employed.

An aperture 23 extends longitudinally through the die 14A, the die aperture 23 being so designed as to form the elongated product 12 with a desired configuration, e.g., with a circular cross-section. Preferably, a compound entry surface, composed of a first wall 24, which tapers conically at a first semicone angle $\alpha$, and a second wall 26, which tapers at a second semicone angle $\beta$, is employed, the walls 24 and 26 positioned to act successively to guide the material of the advancing elongated workpiece 11 toward and into the die aperture 23. We have found that the first angle $\alpha$ should preferably be less than $56\frac{1}{2}°$ and that the second angle $\alpha$ should preferably be greater than $56\frac{1}{2}°$. Such selection of semicone angles results in the creation of a dead zone along the second wall 26 at a position at which the material of the elongated workpiece 11 enters into the die aperture 23, causing such material to shear with respect to itself in order to further enhance the surface appearance and finish of the elongated product 12. Alternatively, however, other die angles, or single angle, tapered entry wall arrangements, might be utilized in the die 14A.

In the operation of the embodiment of FIGS. 1 and 2, the apparatus of FIG. 5 may be utilized, with the die 14A employed in place of the die 14. The elongated workpiece 11 is first coated with the wax 16. Thereafter, frictional drag forces are applied to the wax 16 on the elongated workpiece 11 by the gripping element sectors 17,17 which are moved, in the direction of the arrow 13, toward the die 14A. Thus, the elongated workpiece 11 is caused to advance, first toward, and then through, the die aperture 23. Meanwhile, the surface channels 21,21, which run along the outer periphery 22 of the die 14A, receive substantially all of the coating of the wax 16 on the elongated workpiece 11, which wax 16 would otherwise flow through the die aperture 23 with the advancing, alongated workpiece 11. Thus, substantially all of the wax 16 is removed from each successive longitudinal element of the elongated workpiece 11, substantially as such longitudinal element reaches the die 14A. The removed wax 16 passes axially along the grooves 21,21 in the outer periphery 22 of the die 14A as the elongated workpiece 11 passes through the die aperture 23 in substantially uncoated condition, forming the elongated product 12 with a high quality surface appearance and finish.

Figure 4:
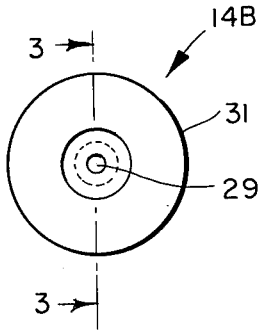
FIG. 4 is an end elevational view of the alternative die of FIG. 3, illustrating additional aspects of the alternative die.

Referring next to FIGS. 3 and 4 of the drawing, an alternative embodiment of the invention is illustrated. A die 14B is substantially similar to the die 14A of FIGS. 1 and 2 in several respects. In particular, a compound entry surface of the die 14B, composed of tapering walls 27 and 28, and an aperture 29, which extends longitudinally through the die 14B, preferably correspond to like elements of the die 14A. The die 14B differs from the die 14A, however, in the nature of the outer periphery 31 of the die 14B. Thus, the outer periphery 31 of the die 14B is substantially identical in both shape and dimensions to the outer periphery of the elongted workpiece 11 beneath the coating of the wax 16.

The operation of the embodiment of FIGS. 3 and 4 is substantially identical to the previously described operation of the embodiment of FIGS. 1 and 2. Frictional drag forces, applied by the apparatus of FIG. 5 to the wax 16 on the elongated workpiece 11 in the direction of the die 14B, serve to advance the elongated workpiece first toward, and then through, the die aperture 29. The outer periphery 31 of the die 14B is so positioned that substantially all of the wax 16 on each successive longitudinal element of the elongated workpiece 11 passes along the outer periphery 31 of the die 14B rather than through the die aperture 29 with the longitudinal element. Thus, substantially all of the wax 16 is removed from the elongated workpiece 11 upon entry into the die 14B, and the elongated workpiece 11 passes through the die aperture 29 in substantially uncoated condition, forming the elongated product 12 with a high quality surface appearance and finish. The embodiment of FIGS. 3 and 4 may be considered a special case of the embodiment of FIGS. 1 and 2, wherein an infinite number, rather than a finite number, of the die surface channels 21,21, is utilized.

It is to be understood that the described methods and apparatus are simply illustrative of preferred embodiments of the invention. Many modifications may, of course, be made in accordance with the principles of the invention.

What is claimed is:

1. A method of forming an elongated product from an elongated workpiece, which elongated workpiece is coated with a hydrostatic medium, the method comprising the steps of:

(a) applying frictional drag forces to the hydrostatic medium in the direction of a die so as to advance the elongated workpiece longitudinally, first toward an aperture extending longitudinally through the die, and then through the die aperture; and (b) removing substantially all of the hydrostatic medium from each successive longitudinal element of the elongated workpiece, substantially as said longitudinal element reaches the die, such that the elongated workpiece passes through the die aperture in substantially uncoated condition.

2. A method as set forth in claim 1, further comprising the preliminary step of:

(c) coating the elongated workpiece with said hydrostatic medium.

3. A method as set forth in claim 1, wherein steps (a) and (b) comprise:

(c) advancing said longitudinal elements of the elongated workpiece successively through an aperture in a die having at least a finite number of surface channels running longitudinally therealong about the outer periphery thereof and so positioned as to remove substantially all of the hydrostatic medium from each successive longitudinal element of the elongated workpiece, substantially as said longitudinal element reaches the die.

4. A method as set forth in claim 1, wherein steps (a) and (b) comprise:

(c) advancing said longitudinal elements of the elongated workpiece successively through an aperture in a die having an outer periphery so dimensioned and so positioned that substantially all of the hydrostatic medium on each successive longitudinal element of the elongated workpiece passes along said die outer periphery rather than passing through the die aperture with said longitudinal element.

5. Apparatus for forming an elongated product from an elongated workpiece, which elongated workpiece is coated with a hydrostatic medium, the apparatus comprising:

a die having an aperture extending longitudinally therethrough;

first means for so applying frictional drag forces to the hydrostatic medium in the direction of said die as to advance the elongated workpiece longitudinally toward and then through the die aperture; and second means, operable on each successive longitudinal element of the elongated workpiece substantially as said longitudinal element reaches the die, for removing substantially all of the hydrostatic medium from said longitudinal element, such that the elongated workpiece passes through the die aperture in substantially uncoated condition.

6. Apparatus as set forth in claim 5, wherein said second means comprises:

said die having at least a finite number of surface channels running longitudinally therealong about the outer periphery thereof, said surface channels being so positioned as to remove substantially all of the hydrostatic medium from each successive longitudinal element of the elongated workpiece, substantially as said longitudinal element reaches the die.

7. Apparatus as set forth in claim 5, wherein said second means comprises:

said die having an outer periphery so dimensioned and so positioned that substantially all of the hydrostatic medium on each successive longitudinal element of the elongated workpiece passes along said die outer periphery rather than passing through the die aperture with said longitudinal element.

8. Apparatus as set forth in claim 5, wherein said die further comprises:

a conically tapering, first entry wall positioned to be engaged by each successive longitudinal element of the elongated workpiece passing into the die aperture, said first entry wall tapering inwardly toward the die aperture at a semicone angle of less than $56\frac{1}{2}°$; and a conically tapering, second entry wall positioned to be engaged by each successive longitudinal element of the elongated workpiece passing into the die aperture, subsequent to said engagement with the first die entry wall, said second entry wall tapering inwardly toward the die aperture at a semicone angle of greater than $56\frac{1}{2}°$.

* * * * *